US007435111B2

(12) United States Patent
Wu et al.

(10) Patent No.: US 7,435,111 B2
(45) Date of Patent: Oct. 14, 2008

(54) ELECTRICAL CONNECTOR

(75) Inventors: Tsu-Yang Wu, Tu-Cheng (TW); Sheng-Ko Chen, Tu-Cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/656,080

(22) Filed: Jan. 22, 2007

(65) Prior Publication Data

US 2007/0173088 A1 Jul. 26, 2007

(30) Foreign Application Priority Data

Jan. 20, 2006 (TW) ..... 95201388 U

(51) Int. Cl.
*H01R 13/44* (2006.01)

(52) U.S. Cl. ..... 439/135; 439/940

(58) Field of Classification Search ..... 439/135, 439/940

See application file for complete search history.

(56) References Cited

U.S. PATENT DOCUMENTS 4,396,245 A * 8/1983 Lane ..... 439/148
5,480,312 A * 1/1996 Watanabe et al. ..... 439/135
5,507,657 A * 4/1996 Seto et al. ..... 439/135
5,688,133 A * 11/1997 Ikesugi et al. ..... 439/135
5,756,937 A * 5/1998 Gleadall ..... 174/138 F
6,019,617 A * 2/2000 Liu et al. ..... 439/135
6,168,444 B1 * 1/2001 Wu et al. ..... 439/135
6,193,529 B1 * 2/2001 Kimura ..... 439/149
6,210,225 B1 * 4/2001 Cai et al. ..... 439/607
6,371,776 B1 * 4/2002 Li et al. ..... 439/135
6,439,901 B1 * 8/2002 Ji et al. ..... 439/135
6,506,064 B1 * 1/2003 Wu ..... 439/135
6,599,140 B1 * 7/2003 Chen et al. ..... 439/135
6,832,922 B2 * 12/2004 Kozono et al. ..... 439/135
7,059,876 B2 * 6/2006 Zhang et al. ..... 439/135
7,153,147 B2 * 12/2006 Li et al. ..... 439/135
2003/0181083 A1 * 9/2003 Kozono et al. ..... 439/152
2005/0106910 A1 * 5/2005 Chiu ..... 439/136
2006/0234533 A1 * 10/2006 Lei et al. ..... 439/135

* cited by examiner

*Primary Examiner*—Tulsidas C. Patel
*Assistant Examiner*—Vladimir Imas
(74) *Attorney, Agent, or Firm*—Wei Te Chung

(57) ABSTRACT

An electrical connector (1) comprises an insulative housing (2) comprising plurality of passageways (25) thereon, a plurality of electrical terminals (4) received in the housing (2), a cover (5) mounted on the housing (2), wherein the cover (5) includes a number of supporting members (52) extending from an inner sidewall thereof for supporting the housing (2), hence preventing the housing (2) from destroying terminals (4).

3 Claims, 3 Drawing Sheets

ELECTRICAL CONNECTOR

BACKGROUND OF THE INVENTION

1. Field of the Invention

The present invention relates to the art of electrical connectors, and more particularly to an electrical connector provided for connecting an electrical applications to a printed circuit board (PCB).

2. Description of the Prior Art

Electrical connectors are widely used in the connector industry for electrically connecting applications to printed circuit boards (PCBs) in personal computer or other consumer electrical equipments. Conventionally, an electrical connector mainly comprises an insulative housing, a multiplicity of terminals received therein, an anchoring hook, a cover mounted on the housing. The housing defines a plurality of receiving passageways for receiving terminals therein. When assembled, the terminals are inserted into the passageways of the housing, and then the cover is mounted above the housing. In this case, the electrical connector is usually positioned on the printed circuit board by a vacuum suction device vacuuming an upper surface of the cover.

However, in the electrical connector abovementioned, the cover is conventional not accurately locating on the housing, and engaged with the housing by a interferential engagement. After a long time, the engagement between the cover and the housing is prone to loose, hence the housing is easy to slide in relative to a predetermined position on the printed circuit board or drop off from the cover engaged by the vacuum suction device. In addition, for securely attaching the housing on the printed circuit board, there needs a powerful force for pressing the cover downwardly, which may destroy the terminal received therein.

Thus, there is a need to provide a new land grid connector assembly that overcomes the above-mentioned problems.

SUMMARY OF THE INVENTION

Accordingly, an object of the present invention is to provide an electrical connector able to accurately locating the cover on the housing.

To fulfill the above-mentioned object, an electrical connector in accordance with a preferred embodiment comprises an insulative housing, a plurality terminals received in the housing, a cover mounted on the housing, and the cover defines a plurality of supporting members and projected elements. In addition, the cover defines a pair of locating plate on two ends thereof and the housing defines a pair of curved locating projection.

Relative to the present technology, the electrical connector in accordance with the preferred embodiment of the invention defines a plurality of supporting members on the sidewalls of the cover, which makes the engagement of the housing and the cover more closed. Furthermore, the locating plates of the cover engage with the curved locating projections of the housing, which makes the cover accurately locating on the housing. At last, the projected elements on inner walls of the cover not only transmits the force applied on the cover effectively to the whole electrical connector but also prevents the terminals received in the housing from being crashed by the cover.

Other objects, advantages and novel features of the present invention will become more apparent from the following detailed description when taken in conjunction with the accompanying drawings, in which:

DESCRIPTION OF PREFERRED EMBODIMENT OF THE INVENTION

Reference will now be made to the drawings to describe the present invention in detail.

Figure 1:
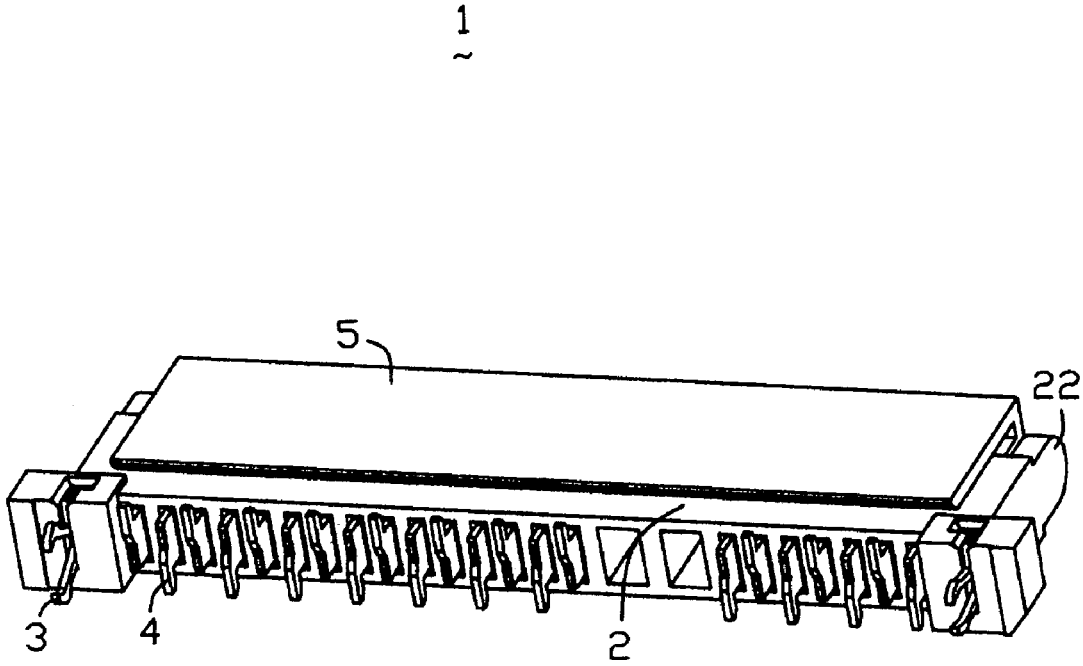
FIG. 1 is an assembled view of an electrical connector in accordance with a preferred embodiment of the present invention.
Figure 2:
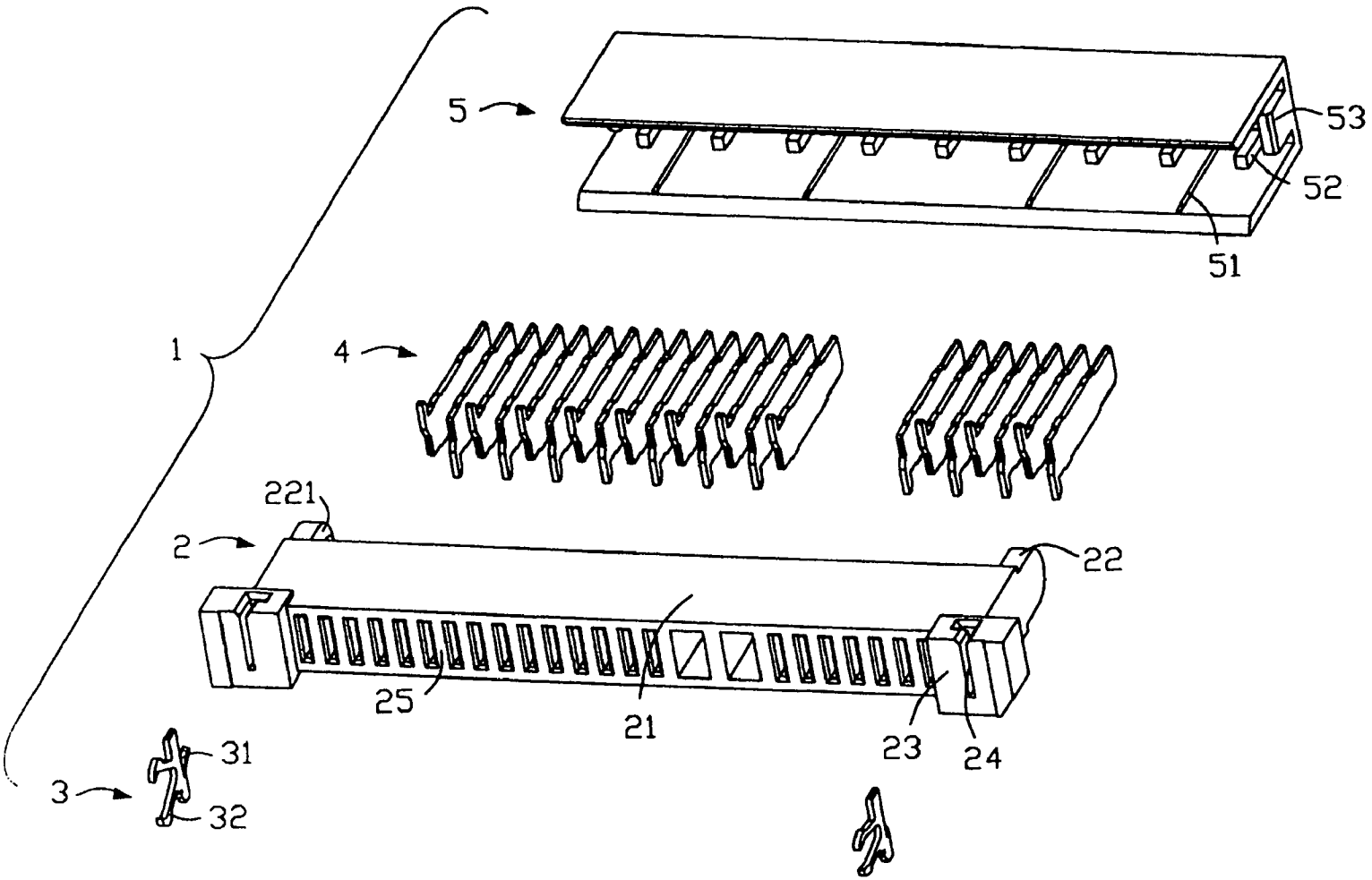
FIG. 2 is an exploded, isometric view of terminal of the electrical connector shown in FIG. 1.

Referring to FIGS. 1-2, an electrical connector 1 in accordance with the preferred embodiment of the present invention provided for electrically connecting a application to a PCB includes a generally rectangular insulative housing 2, a pair of anchoring hooks 3, a multiplicity of terminals 4 received in the housing 2 and a cover 5 attached on the housing 2.

The housing 2 includes a rectangular base portion 21, and defines a mating face (not labeled) and a back face (not labeled) opposite to the mating face. The base portion 21 defines a pair of locating portions 22 on two ends thereof and projecting forwardly beyond the mating face which define a slant surface 221 on an end thereof respectively. In addition, the base portion 21 defines a pair of rectangular base substrates 23 on two rear ends thereof adjacent to the back face and each base substrate 23 defines a recess 24 on a bottom surface (mounting surface which parallel to the mating face thereof. The base portion 21 further defines a plurality of passageways 25 for receiving the terminals 4 therein between the two locating projections 22.

The anchoring hook 3 comprises a securing portion 31 and inverted U-shaped trip portion 32. The anchoring hook 3 is used for fixing the electrical connector on the printed circuit board.

Figure 3:
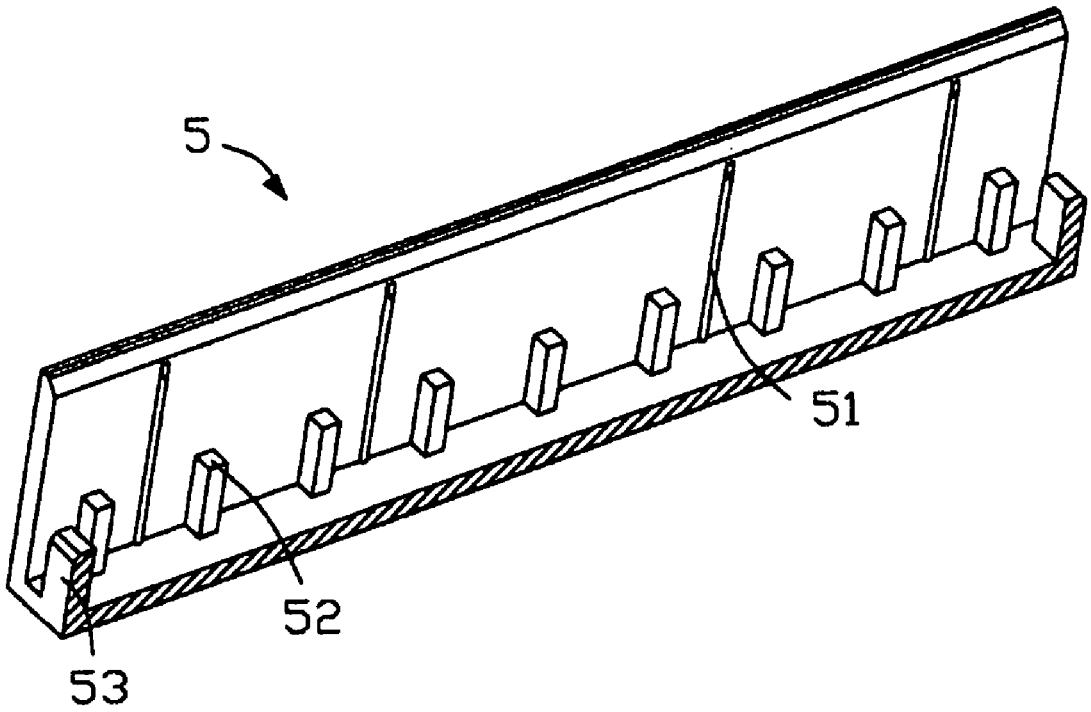
FIG. 3 is a cross-sectional view of the cover in the electrical connector of FIG. 1, in line of transverse symmetry direction.

Referring to FIG. 3, the cover 5 is generally configured as U- shaped concave with sidewalls therearound and comprises a plurality of engaging element 51 and supporting members 52 on inner surfaces of the sidewalls. In addition, the cover 5 defines a pair of locating portions 53 on two ends thereof. The engaging elements 51 are flushed with sidewalls of the cover 5 and the supporting members 52 extend from a bottom surface of the cover 5 to a position with a half height of the sidewall. The engaging elements 51 and the supporting memebers 52 staggered with one another.

In assembly, the terminals 4 are firstly inserted into the passageways 25 of the housing 2. The anchoring hooks 3 are then mounted into the recesses 24 of the base substrate 23. At last, the cover 5 is attached to the housing 2 between the locating projections 22. The locating projections 22 can lead the locating portion 53 into the housing 2 by the slant surfaces 221 thereof. In addition, the engaging element 51 of the cover 5 can make the engagement between the cover 5 and the housing 2 more fittingly and reliably. In assembling electrical connector 1, the supporting memebers 52 abut against the upper surface of the housing 2 and the lengths of the supporting memebers 52 are enough to prevent the terminals 4 from contacting with the cover. The supporting memebers 52 are not interferentially engaged with terminals 4. The electrical connector 1 is locating on the printed circuit board by a vacuum suction device vacuuming an upper surface of the cover 5. Successively, the cover 5 is pressed downwardly toward the housing 2 by an outer force and the force transmitted by the supporting memebers 52 to the whole electrical connector 1 thereby the electrical connector 1 is secured mounted on the printed circuit board. At last, the anchoring hooks 3 connect the electrical connector 1 to the printed circuit board.

Although the present invention has been described with reference to a particular embodiment, it is not to be construed as being limited thereto. Various alterations and modifications can be made to the embodiment without in any way departing from the scope or spirit of the present invention as defined in the appended claims.

What is claimed is:

1. An electrical connector comprising:

an insulative housing defining a mating face and a mounting surface parallel to the mating face and comprising a plurality of passageways thereon and a pair of projections protruding forwardly beyond the mating face;

a plurality of electrical terminals received in the housing;

a cover mounted on the housing comprising a number of supporting members spatially arranged on one sidewall of the cover and extending from a bottom surface thereof with a lower length than sidewalls of the housing, a pair of locating portions at two ends thereof cooperating with the projections, and a plurality of engaging elements in the inner side walls thereof and staggered with the supporting members.

2. The electrical connector as claimed in claim 1, further comprising a pair of anchoring hooks, and each defining a securing portion and a trip portion, the mounting surface defines a pair of corresponding recesses indented therefrom.

3. An electrical connector comprising:

an insulating housing defining an upwardly mating port with a plurality of electrical terminals received therein and with an opening communicating with an exterior;

a pair of towers extending upwardly from two opposite ends of the housing; and a cover mounted on the housing and defining a horizontal plate and two vertical side plates extending downwardly from the horizontal plate, and two locating portions extending downwardly at two opposite longitudinal ends of the horizontal plate; wherein the cover includes a number of supporting members extending from at least one an interior surface and seated upon a top face of said housing at said opening, so that the horizontal plate is spaced from the top face with a distance not less than the length of the supporting member, under a condition that said two locating portions abut against the two towers.

* * * * *